United States Patent [19]

Fickenscher et al.

[11] Patent Number: 4,851,383

[45] Date of Patent: Jul. 25, 1989

[54] NON-LAMINATE THERMOSENSITIVE, PRESSURE SENSITIVE LABEL AND METHOD OF MANUFACTURE

[75] Inventors: John Fickenscher, Orange; Wissam Jurdi, Tustin; Tomoo Shibata, Irvine, all of Calif.

[73] Assignee: Ricoh Electronics, Inc., Irvine, Calif.

[21] Appl. No.: 59,577

[22] Filed: Jun. 8, 1987

[51] Int. Cl.[4] ..... B41M 5/18

[52] U.S. Cl. ..... 503/200; 428/40; 428/447; 428/913; 428/914; 503/226

[58] Field of Search ..... 503/200, 226; 428/40, 428/447, 913, 914

[56] References Cited

U.S. PATENT DOCUMENTS

| | | | |
|---|---|---|---|
| 4,288,496 | 9/1981 | Reusser et al. | 428/447 |
| 4,525,566 | 6/1985 | Homan et al. | 428/447 |
| 4,720,479 | 1/1988 | Craig et al. | 503/226 |

FOREIGN PATENT DOCUMENTS

| | | | |
|---|---|---|---|
| 59-107264 | 7/1984 | Japan | 503/226 |
| 59-179071 | 11/1984 | Japan | 503/226 |
| 0054842 | 3/1985 | Japan | 503/226 |

*Primary Examiner*—Bruce H. Hess

*Attorney, Agent, or Firm*—Walter A. Hackler

[57] ABSTRACT

A thermosensitive pressure sensitive label is provided which includes a substrate, a thermosensitive layer on one side of the substrate and a pressure sensitive adhesive layer disposed on an opposite side of the substrate. A barrier layer on top of the thermosensitive layer is covered with a silicone layer which enables the label to be rolled upon itself and unrolled without the use of a conventional backing sheet. In addition, the silicone layer enables color images formed in the thermosensitive layer to have a greater image density than the image density of color images that can be formed in the thermosensitive layer without the silicone layer being disposed thereover.

12 Claims, 1 Drawing Sheet

NON-LAMINATE THERMOSENSITIVE, PRESSURE SENSITIVE LABEL AND METHOD OF MANUFACTURE

The present invention relates generally to thermosensitive recording labels and a method of manufacture thereof. More particularly, the present invention relates to thermosensitive recording labels which can be stored with significantly increased packing density compared to conventional thermosensitive labels.

Thermosensitive recording labels have a significant advantage over conventional oil or water-base ink printed labels. These advantages have been described in U.S. Pat. No. 4,370,370 and in U.S. Pat. No. 4,577,204, which patents are co-assigned to the present assignee of record and are incorporated into the present patent application by specific reference thereto.

In general, a thermosensitive pressure sensitive label includes a substrate, a color-forming layer disposed on one side of the substrate with a barrier layer disposed over the color-forming layer and on an opposite side of the substrate to prevent fading of heat-formed printing in the color-forming layer and/or discoloration thereof.

Pressure-sensitive adhesive is disposed over the barrier on the opposite side of the label and typically a backing paper is disposed thereon to protect the adhesive until use.

The backing paper usually incorporates a releasing agent, such as silicone, to facilitate removal of the backing sheet from the adhesive coated label when the label is to be disposed on packaged goods, or the like.

Typically, in the manufacture of pressure sensitive labels, the label and backing sheet with the pressure sensitive adhesive therebetween is produced in a long continuous strip which is rolled for storage and handling purposes.

This continuous strip of labels is usually "converted" in order to enhance its usefulness to the purchaser thereof.

The "converting" of a label strip typically includes the printing of background information and cutting of the continuous label strip with a die into desired individual label shapes, with the die penetrating and cutting only the label material while leaving the backing sheet uncut. The uncut backing sheet then serves to support the cut labels and enable the rolling of the final converted label into a roll for storage and delivery.

It should be noted that the backing sheet may represent up to 40 percent or more of the total thickness of the final label as stored. It also represents approximately one-half of the weight of a roll of converted labels. Therefore, it is desirable to eliminate the backing sheet in order to double the number of usable labels that can be stored in a given roll, or stack, of labels. It follows that the total weight of such a roll would be significantly less than the weight of the same number of labels having a backing sheet attached thereto.

Other associated cost savings accompany the elimination of the backing paper. Such savings include reduced shipping cost, reduced storage cost, as well as reduced handling cost and, importantly, the elimination of waste product.

A purchaser/user of the labels, such as a retail store, distributor or manufacturer of goods, typically imprints each label with specific information, such as price and weight, relating to the specific package to which it is to be attached, and thereafter peels the label from the backing sheet and places it upon a particular item.

The waste product in this operation is the backing sheet and skeletal portions of the label which remain on the backing strip after the usable label, having a defined shape and size smaller than the underlying backing sheet, is removed.

This represents a significant handling and disposal problem as half of the delivered label product, namely, the backing sheet and skeletal portions of the label must be separately handled and discarded.

Because of the hereinabove identified advantages of eliminating the backing sheet on a thermosensitive pressure sensitive label, attempts have been made to coat a release layer on top of the color-forming layer so that a strip of labels can be rolled with the relase layer in contact with the pressure sensitive adhesive to enable the labels to be unrolled by separation of the release layer from the adhesive.

This arrangement, however, introduces many new problems. First, if the separation between the pressure sensitive adhesive and the release layer on the color-forming layer is not clean, i.e., a portion of the adhesive remains on the color-forming layer, the remaining adhesive will come into contact with the heated print head used to activate the color-forming layer. When this occurs, the adhesive sticks to the head and thereafter causes lower heat transfer and blurring of the images formed in the color-forming layer. This results in increased maintenance costs and down time associated with the cleaning of the print heads.

If all the adhesive remaining on the color-forming layer does not stick to the print head, it can adhere to other packages or accumulate dirt, thereby making the label look unattractive.

In addition to this, the release layer coated on the color-forming layer may act an an insulation or diffuser of heat from the print head during contact therewith, thereby blurring images formed in the color-forming layer.

The present invention provides for a non-laminate thermosensitive, pressure sensitive label having no backing sheet overcoming the hereinabove recited problems.

SUMMARY OF THE INVENTION

A thermosensitive, pressure sensitive label in accordance with the present invention includes a substrate, thermosensitive color-forming layer, a barrier layer, a pressure sensitive adhesive and silicone layer.

More particularly, the thermosensitive layer includes a top surface and a bottom surface, with the thermosensitive color-forming layer being disposed on one side of the substrate with the bottom surface thereof in contact therewith. The thermosensitive layer provides means for forming color images of measurable image density when a preselected portion thereof is heated by a thermal printing head.

The pressure sensitive adhesive is disposed on an opposite side of the substrate and the silicone layer is capable of being placed in contact with, and thereafter separated from, the pressure sensitive adhesive. This silicone layer is disposed on the barrier layer which is disposed on the top surface of the thermosensitive color-forming layer.

No backing layer is necessary for the present label.

When the substrate is rolled, the release layer on top of the thermosensitive color-forming layer, contacts the pressure sensitive adhesive.

When unrolled, the release layer separates from the pressure sensitive adhesive, and the substrate may be cut or torn into separate labels for attachment to packaged goods by means of the pressure sensitive adhesive disposed on the substrate. The type and thickness of the release layer is chosen so that no damage is caused to the color-forming layer when the backing layer is pulled away from the pressure sensitive adhesive on top of the color-forming layer.

Importantly, the silicone layer also provides a means for enhancing the density of color images formed by the thermosensitive layer. This result is unexpected and the reasons therefor are not readily apparent. Of specific use as a silicone layer is alkoxy-functional polydimethylsiloxane and Tetanate which is curable in most room temperatures and causes the color images formed by the thermosensitive layer, in response to heating by a thermal printing head, to have up to about 25 percent greater image density than the image density of color images that can be formed by the thermosensitive layer by the thermal printing head without the silicone layer.

A plurality of thermosensitive, pressure sensitive labels may be formed by perforating the substrate, to enable easy separation thereof, into individual labels after it has been unrolled from a storage roll of labels. This separation is typically done after final printing on the thermosensitive pressure sensitive label and just before attachment of the label to packaged goods or the like.

While the thermosensitive color-forming layer may be any suitable composition, such as a leuco dye system, or a metallic dye system, which forms color patterns in response to a heated printing head, it is preferable that the thermosensitive color-forming layer include a colorless or light-colored leuco dye and an acidic substance capable of causing the leuco dye to undergo a color formation upon heating thereof.

Any suitable pressure sensitive adhesive may be used, such as SBR latex adhesive agents, acrylic adhesive agents, vinyl acetate adhesive agents, rubber adhesive agents, hot melt adhesive agents, and radiation cured pressure sensitive adhesives.

The silicone layer of the present invention functions in three ways.

First, the silicone layer enables the label to be rolled onto itself, and thereafter unrolled without physical damage to the color-forming layer, and without any backing strip as has been used on conventional labels heretofore.

Second, as hereinabove pointed out, the silicone layer enhances the image density of color image formed by the thermosensitive layer.

Third, the silicone layer also supplements the barrier layer in preventing the bleeding, or fading, of the color formations in the thermosensitive layer by preventing migration thereinto by external chemical agents.

As was discussed in U.S. Pat. Nos. 4,370,370 and 4,577,204, hereinbefore incorporated by reference, external chemical agents, such as plasticizers, found in polyethylene or polyolefin films, tend to migrate from plastic comingled packages into the thermosensitive color-forming layer and cause fading of the color formations therein.

Such fading is undesirable because a customer may attribute a faded label to stale, or old, goods. This concern is of particular importance in the retail food industry.

A method of manufacturing thermosensitive, pressure sensitive labels in accordance with the present invention, includes the steps of disposing a thermosensitive layer to one side of a substrate, disposing a pressure sensitive adhesive layer on an opposite side of the substrate and disposing a barrier layer on top of the thermosensitive layer. A moist air curable silicone release layer is disposed on top of the barrier layer and exposed to air containing sufficient moisture for a sufficient length of time to cure the curable silicone release layer.

In addition, a method in accordance with the present invention may include the step of perforating the substrate to enable later separate thereof into a plurality of separated, individual thermosensitive, pressure sensitive labels.

To achieve high storage density, the method of manufacturing thermosensitive pressure sensitive labels further includes the step of rolling the substrate with the thermosensitive color-forming layer, pressure sensitive adhesive, and release layer thereon, to form a roll of separable labels, with the release layer in contact with the top surface of the thermosensitive color-forming layer.

BRIEF DESCRIPTION OF THE DRAWINGS

A better understanding of the present invention may be had from the consideration of the following detailed description, taken in conjunction with the accompanying drawings in which.

DETAILED DESCRIPTION OF THE DRAWINGS

Figure 1:
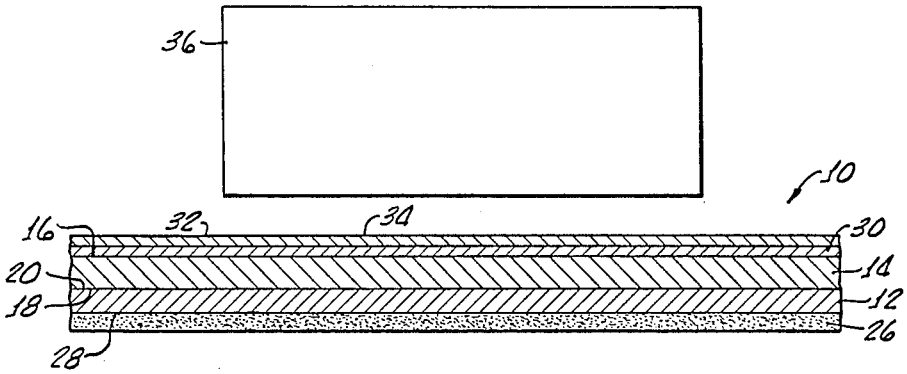
FIG. 1 is a cross-sectional view of the thermosensitive, pressure sensitive label in accordance with the present invention, generally showing each of the layers therein.

Turning now to FIG. 1, the thermosensitive, pressure sensitive label in accordance with the present invention, generally includes a substrate 12 and a thermosensitive layer 14 having a top surface 16 and a bottom surface 18. The thermosensitive layer 14 is disposed on one side 20 of the substrate 12, with the bottom surface 18 in contact therewith.

A layer 26 of pressure sensitive adhesive is disposed on an opposite side 28 of the substrate 12 and a silicone layer 32 is disposed on a barrier layer 30 covering the thermosensitive layer top surface 16. As will be hereinafter discussed in greater detail, the silicone layer 32 is capable of being placed in contact and thereafter separated from the pressure sensitive adhesive layer 26 without significant damage to the thermosensitive layer 14.

In general, the substrate 12 may be a high quality paper, or the like, and the thermosensitive layer 14 may be any suitable color-forming system, such as a leuco dye system, or a metallic dye system, both of which are well known in the art.

For example, a suitable leuco dye system is described in U.S. Pat. Nos. 4,370,370 and 4,388,362, the latter patent being incorporated herewith by specific reference thereto for showing, with U.S. Pat. No. 4,370,370, examples of the colorless or light-colored leuco dye systems typical in the art.

Other optional components of the leuco dye system may be included, as is well known in the art, such as color enhancers and binders.

The pressure sensitive adhesive 26 may be of any suitable type, as for example, a hot melt adhesive, such as thermoplastic rubber copolymer or acrylic thermoplastic hot melt adhesives. The barrier layer 30 may be a water soluble resin solution coated on the thermosensitive layer 14 and thereafter dried. A number of water soluble resins may be utilized as the barrier layer 30, such as, polyvinyl alcohol.

It has been discovered that moist air cured silicone systems when disposed on the barrier barrier layer 30 enhance the image density of color images formed thereby. For example, the silicone system may be an X2-8100 PTC coating and RTC catalyst available from Dow Corning. The system water cures from moisture in the air at room temperatures, and can be described as alkoxy-functional polydimethylsiloxane + Tetanate moisture cured silicone coating or

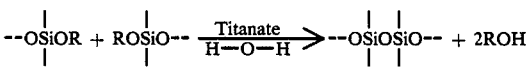

It has been found that the silicone system cannot be applied directly to the thermosensitive layer 14 without discoloration, or unwanted color formation in the thermosensitive layer. Therefore, the barrier layer is utilized to prevent direct contact with the silicone layer 32.

Notwithstanding the barrier layer 30 being disposed between the silicone layer 32 and the thermosensitive layer 17, the silicone layer enhances the image density formed by the thermosensitive layer upon heating thereof as set forth in the hereinafter Example.

As hereinbefore discussed, the silicone layer 32 also, in combination with the barrier layer, protects layer 14 from damage by the pressure sensitive adhesive 26 when the label 10 is wound into a roll 40 with the release layer 30 being thereby placed in contact with the pressure sensitive adhesive 26. It has been found that a thickness of silicone corresponding to a layer evenly applied to the barrier layer at between about 0.5 lbs./3000 sq. ft. and 1.5 lbs./3000 sq. ft. is sufficient to enable release of the pressure sensitive adhesive layer 26 without damage to the thermosensitive layer 14.

Importantly, between about 0.5 lbs./3000 sq. ft. and about 1.5 lbs./3000 sq. ft. of silicone on the barrier layer also promotes the formation of color patterns in the underlying color-forming layer 14 upon application of heat to a face surface 34 thereof by means of a conventional heated printing head 36.

Figure 2:
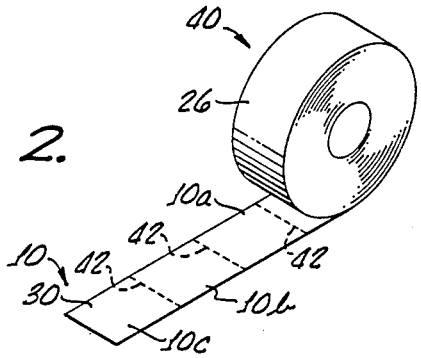
FIG. 2 is a perspective view of a plurality of thermosensitive, pressure sensitive labels rolled for compact storage, and illustrating perforations in the substrate layer of the label which enable separation thereof into separated individual thermosensitive, pressure sensitive labels; and, FIG. 3 is a diagram illustrating a method of manufacture of non-laminate thermosensitive, pressure sensitive labels, in accordance with the present invention.

As indicated in FIG. 2, the substrate 12, as well as all other layers of the present label, may be perforated, as shown by the dotted lines 42, to enable the pressure sensitive label 10 to be separated into individual thermosensitive pressure sensitive labels 10*a*, 10*b* and 10*c*.

As hereinbefore discussed, the silicone layer 30 functions to protect the color thermosensitive layer 14 from the pressure sensitive adhesive 26 to prevent migration of external chemical agents, such as plasticizers present in common polyethylene and polyolefin films, from migrating into the color-forming layer 14 and causing fading thereof and to enhance the density of color images formed by the thermosensitive layer.

Figure 3:
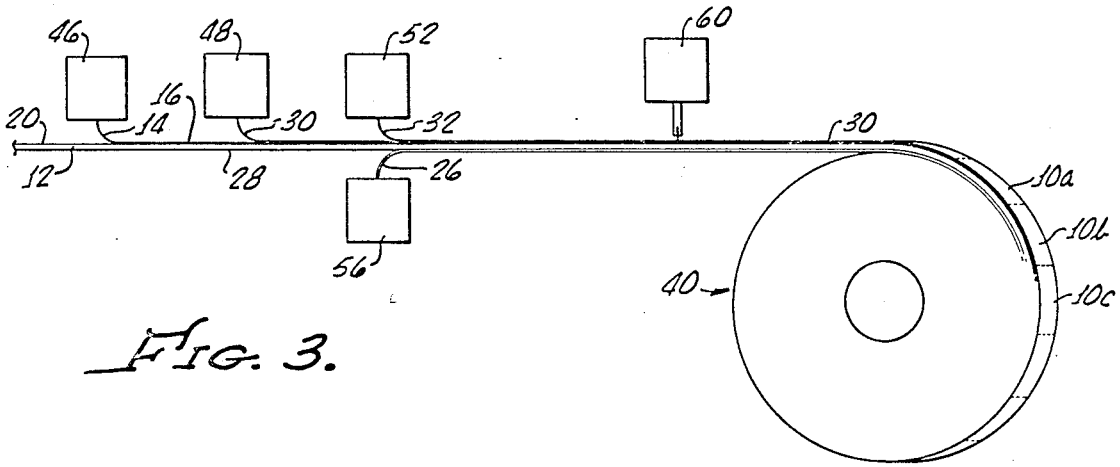

Turning now to FIG. 3, there is illustrated a method of manufacturing thermosensitive pressure sensitive labels in accordance with the present invention. Onto the substrate 12, which has a length substantially longer than that of individual pressure sensitive labels 10*a*, 10*b*, 10*c*, (FIG. 2), a thermosensitive layer 14 is deposited on the one side 20 of the substrate 12 by any suitable apparatus 46.

Thereafter, the substrate 12 is moved to another position in which the barrier layer 30 is applied on the top surface 16 of the thermosensitive layer 14 by means of apparatus 48 in a conventional manner. After drying of the barrier layer 30, the silicone layer is deposited onto the barrier layer in an amount between about 0.5 lbs./3000 sq.ft. and 1.5 lbs./3000 sq. ft. by conventional apparatus 52, such as used in the knife-over-roll method. Thereafter, the silicone layer is cured at room temperature under normal humidity conditions for about 2–5 seconds.

On the opposite side 28 of the substrate 12, the pressure sensitive adhesive 26 is deposited by conventional apparatus 56.

The application of the pressure sensitive adhesive 26 to the opposite side 28 of the substrate 12 may occur at any time relative to the application of the color-forming layer 14. Hence, it should be appreciated that any suitable order of application of the layers comprising the thermosensitive pressure sensitive label of the present invention may be used.

Similarly, as shown in FIG. 3, apparatus 60 for perforating the substrate 12 may be disposed in any suitable position relative to the coating apparatus 46, 48, 52 and 56.

Finally, the substrate 12, with the thermosensitive layer 14, pressure sensitive adhesive 26, barrier layer 30 and silicone layer 32 thereon, may be rolled to form a roll 40 of separable labels 10*a*, 10*b*, 10*c*, with the pressure sensitive adhesive 26 in contact with the silicone layer 32 on the top surface 20 of the color-forming layer 14.

The following Example is presented by way of illustration only, and is not to be considered limited to the present invention.

EXAMPLE 1

A solution of leuco dye and acid substance was prepared as follows:

| | Parts by Weight |
|---|---|
| Dispersant A | |
| 3-diethyl-6-methyl-7-anilino fluoran | 1.5 |
| Polyvinyl alcohol (20% aqueous solution) | 5.0 |
| Water | 43.5 |
| Dispersant B | |
| Bisphenol A | 6.0 |
| Stearic acid amide | 1.0 |
| Polyvinyl alcohol (20% aqueous solution) | 10.0 |
| Water | 33.0 |

The prepared Dispersant A and Dispersant B were mixed to form a thermosensitive coloring liquid which was applied to a substrate consisting of high quality paper and weighing about 58 gr./m$^2$, and thereafter dried at room temperature up to 120° C. to form a thermosensitive color-forming layer in which the solids therein amounted to about 4.0 to about 10 gr./m$^2$. Thereafter, a water soluble resin solution comprising 5 parts of polyvinyl alcohol in 95 parts of water was applied to the heat sensitive color-forming layer and dried at about 25° to 120° C. to thereby form a layer over the thermosensitive color-forming layer, said barrier layer being a quantity of solids of about 2 gr./m$^2$.

The silicone release was prepared by mixing 9 parts of Dow Corning X2-8100 coating with 1 part of RTC catalyst - Titanate and applied over the barrier layer in a thickness of about 1$\mu$ and allowed to cure for about 3 seconds in air at room temperature, atmospheric moisture. A radiation cured pressure sensitive adhesive was applied to an opposite side of the substrate.

The label was then rolled with the pressure resistant adhesive in contact with the silica layer. Upon unrolling, no significant amount of adhesive remained on the silicone layer.

Thereafter, a printing head at about 150° C. was contacted with the label for about 2 seconds to produce an image having an image density, measured by a Macbeth Model No. RD-921 reflection densitometer, of about 1.69.

EXAMPLE 2

A label was prepared in accordance with the procedure set forth in Example 1 except that no silicone layer was disposed over the barrier layer and the label was not rolled. Upon contacting the same printing head at about 150° C. for about 2 seconds as set forth in Example 1, an image was formed having an image density, measured by a Macbeth Model No. RD-921 reflection densitometer of about 1.32.

This represents more than about a 25 percent increase in image density than without the silicone layer.

Although there has been described hereinabove a specific thermosensitive pressure sensitive label in accordance with the present invention for the purposes of illustrating the manner in which the invention may be used to advantage, it will be appreciated that the invention is not limited thereto. Accordingly, any and all modifications, variations, or equivalent arrangements which may occur to those skilled in the art, should be considered to be within the scope of the invention as defined in the appended claims.

What is claimed is:

1. A thermosensitive, pressure sensitive label comprising:

a substrate;

thermosensitive layer means for forming color images of measurable image density when a preselected portion thereof is heated by a thermal printing head, said thermosensitive layer means being disposed on one side of said substrate with a bottom surface thereof in contact with said substrate;

a pressure sensitive adhesive layer disposed on an opposite side of said substrate;

a barrier layer disposed on a top surface of the thermosensitive layer means; and silicone layer means, disposed on said barrier layer, for causing color images formed in said thermosensitive layer means, in response to heating by the thermal printing head, to have a greater image density than the image density of color images that can be formed in the thermosensitive layer means by the thermal printing head without the silicone layer means being disposed on said barrier layer, said silicone layer means being further operative for enabling the thermosensitive pressure sensitive label to be rolled with the pressure sensitive adhesive layer in contact with the silicone layer means and unrolled without significant adhesion to the silicone layer means, said silicone layer means comprising a moist air cured silicone system.

2. The thermosensitive, pressure sensitive label according to claim 1 wherein the silicone system comprises alkoxy-functional polydimethylsiloxane and titanate and the thermosensitive layer means comprises a colorless or light-colored leuco dye and an acidic substance capable of causing said leuco dye to undergo color-formation upon heating thereof.

3. The thermosensitive pressure sensitive label according to claim 2 wherein the silicone layer means causes color images formed by said thermosensitive layer means, in response to heating by the thermal printing head, to have up to about 25 percent greater image density than the image density of color images that can be formed by the thermosensitive layer means by the thermal printing head without the silicone layer means being disposed on said barrier layer.

4. The thermosensitive pressure sensitive label according to claim 3 wherein the amount of the silicone layer means disposed on the barrier layer is between about 0.5 lbs./3000 sq. ft. and about 1.5 lbs./3000 sq. ft.

5. The thermosensitive recording label in accordance with claim 4 wherein the pressure sensitive adhesive layer comprises a radiation cured pressure sensitive adhesive agent.

6. The thermosensitive pressure sensitive label according to claim 5 wherein the barrier layer comprises polyvinyl alcohol.

7. A thermosensitive, pressure sensitive label comprising:

a substrate;

thermosensitive layer means for forming color images of measurable image density when a presented portion thereof is heated by a thermal printing head, said thermosensitive layer means being disposed on one side of said substrate with a bottom surface thereof in contact with said substrate;

a pressure sensitive adhesive layer disposed on an opposite side of said substrate;

silicone layer means, for causing color images formed in said thermosensitive layer means, in response to heating by the thermal printing head, to have a greater image density than the image density of color images that can be formed in the thermosensitive layer means by the thermal printing head without the silicone layer means being disposed on said barrier layer, said silicone layer means being further operative for enabling the thermosensitive pressure sensitive label to be rolled with the pressure sensitive adhesive layer in contact with the silicone layer means and unrolled without significant adhesion to the silicone layer means, said silicone layer means comprising a moist air cured silicone system; and barrier layer means, disposed between a top surface of the thermosensitive layer means and said silicone layer means, for preventing interaction between the thermosensitive layer means and the silicone layer means during application of the silicone layer means.

8. The thermosensitive pressure sensitive label according to claim 7 wherein the silicone layer means comprises alkoxy-functional polydimethylsiloxane and titanate and the thermosensitive layer means comprises a colorless or light-colored leuco dye and an acidic substance capable of causing said leuco dye to undergo color-formation upon heating thereof.

9. The thermosensitive pressure sensitive label according to claim 8 wherein the silicone layer means causes color images formed in said thermosensitive layer means, in response to heating by the thermal printing head, to have up to about 25 percent greater image density than the image density of color images that can be formed in the thermosensitive layer means by the thermal printing head without the silicone layer means being disposed on said barrier layer.

10. The thermosensitive pressure sensitive label according to claim 9 wherein the amount of the silicone layer means disposed on the barrier layer is between about 0.5 lbs./3000 sq. ft. and about 1.5 lbs./3000 sq. ft.

11. The thermosensitive recording label in accordance with claim 10 wherein the pressure sensitive adhesive layer comprises a radiation cured pressure sensitive adhesive.

12. The thermosensitive pressure sensitive label according to claim 11 wherein the barrier layer comprises polyvinyl alcohol.

* * * * *